US005762595A

United States Patent [19]

Santiago et al.

[11] Patent Number: 5,762,595

[45] Date of Patent: Jun. 9, 1998

[54] FLAT-SITTING CONTAINER BOTTOM END CLOSURE AND MECHANISM FOR FORMING SAME

[75] Inventors: Gonzalo D. Santiago, Commece Township; Michael L. Davis, Ann Arbor, both of Mich.

[73] Assignee: Elopak Systems AG, Glattbrugg, Switzerland

[21] Appl. No.: 720,611

[22] Filed: Oct. 1, 1996

[51] Int. Cl.[6] ..... B31B 1/28

[52] U.S. Cl. ..... 493/133; 493/143; 493/218; 493/936

[58] Field of Search ..... 493/133, 143, 493/218, 936, 135, 141, 142, 144, 145, 146, 183, 184, 160; 53/456, 467, 477, 491

[56] References Cited

U.S. PATENT DOCUMENTS

| | | | |
|---|---|---|---|
| Re. 29,568 | 3/1978 | Braun | 156/580.2 |
| 2,070,747 | 2/1937 | Orstrom | 229/37 |
| 2,232,088 | 2/1941 | Waters | 229/61 |
| 2,563,619 | 8/1951 | Ringler . | |
| 3,120,335 | 2/1964 | Egleston et al. | 229/43 |
| 3,196,068 | 7/1965 | Schoder . | |
| 3,270,940 | 9/1966 | Egleston et al. | 229/17 |
| 3,303,761 | 2/1967 | Monroe . | |
| 3,422,730 | 1/1969 | Mitzenfelt . | |
| 3,498,524 | 3/1970 | Braun | 229/38 |
| 3,912,576 | 10/1975 | Braun | 156/580 |
| 3,971,300 | 7/1976 | Bachner . | |
| 4,011,800 | 3/1977 | Walke . | |
| 4,211,357 | 7/1980 | Lisiecki | 229/17 G |
| 4,266,993 | 5/1981 | Olsen | 156/69 |
| 4,292,787 | 10/1981 | Buschor | 53/456 |
| 4,374,697 | 2/1983 | Tsuzuki | 156/580.2 |
| 4,546,915 | 10/1985 | Lisiecki | 229/17 G |
| 4,569,474 | 2/1986 | Buschor | 229/37 R |
| 4,669,253 | 6/1987 | Shavit | 53/455 |
| 4,795,086 | 1/1989 | Farber | 229/137 |
| 4,838,847 | 6/1989 | Kume et al. | 493/133 |
| 5,056,707 | 10/1991 | Larsen | 229/104 |
| 5,135,463 | 8/1992 | Hydruk | 493/133 |
| 5,152,736 | 10/1992 | Owen et al. | 493/133 |
| 5,222,667 | 6/1993 | Fukikawa | 229/137 |
| 5,295,941 | 3/1994 | Fujikawa | 493/133 |
| 5,421,512 | 6/1995 | Poole | 229/249 |
| 5,626,285 | 5/1997 | Redford | 229/132 |

FOREIGN PATENT DOCUMENTS 1013155 12/1965 United Kingdom .

*Primary Examiner*—Joseph J. Hail, III
*Assistant Examiner*—Christopher W. Day
*Attorney, Agent, or Firm*—Reising, Ethington, Learman & McCulloch, PLLC

[57] ABSTRACT

A flat-sitting bottom end closure for liquid filled, thermoplastic-coated paperboard containers, and mechanism for forming same. The mechanism includes an indexible rotor having a plurality of mandrels on which tubular container blanks are mounted, wherein each mandrel has an end cap defining a configuration which, in conjunction with a complementary pressure pad, produces four flat corner portions or pedestals on the container bottom end closure when confined between the pressure pad and each end cap.

5 Claims, 3 Drawing Sheets

FLAT-SITTING CONTAINER BOTTOM END CLOSURE AND MECHANISM FOR FORMING SAME

TECHNICAL FIELD

This invention relates generally to liquid-filled containers, and, more particularly to such containers with stable, flat-sitting or "non-rocking" bases, and the mechanism for forming same.

BACKGROUND ART

Heretofore, the bottom end closures of liquid-filled, thermoplastic-coated paperboard containers, while generally flat, have had a tendency to assume a somewhat convex or downwardly bulged shape, once the container is filled, due to the flexibility or resiliency of the paperboard and, hence, may not stand directly upright during storage and/or shipping Kume et al U.S. Pat. No. 4,838, 847 discloses a container bottom forming apparatus including a mandrel having an end cap whose end surface defines a pyramidal-shaped cavity for recessing the bottom central portion of the container end panels, and a pressure pad having a projection complementary to the cavity, for pressing the end panels therebetween.

Larsen U.S. Pat. No. 5,056,707 discloses a particular mandrel end configuration and cooperating pressure pad configuration for forming a carton bottom arrangement having four outwardly protruding corners.

Orstrom U.S. Pat. No. 2,070,747 discloses a folded receptacle for liquid wherein the bottom closure is subjected to a pressing action such that bulbs or extensions are formed at the corners thereof.

Waters U.S. Pat. No. 2,232,088 discloses a container having a generally arched bottom formation resulting in ears of extended material at oppositely disposed sides of the bottom closure.

British patent no. 1,013,155 discloses a box folded from a blank having slits therein which result in feet being formed at the corners of the erected box.

Owen et al U.S. Pat. No. 5,152,736 discloses a concave shaped container bottom end closure wherein the final top closure is folded and sealed first on a rotor mandrel, and then the final bottom closure having particular diagonal and sloped score line modifications is formed and sealed by modified sealing jaws along a conveyor after the container is filled with a liquid. Another concave container end wall and apparatus for forming same is shown and described in Shavit U.S. Pat. No. 4,669,253.

Conventional container bottom end closures are shown and described in the following patents: Egleston et al U.S. Pat. Nos. 3,120,335 and 3,270,940; Braun U.S. Pat. No. 3,498,524; Lisiecki U.S. Pat. Nos. 4,211,357 and 4,546,915; and Farber U.S. Pat. No. 4,795,086 discloses a machine for forming container bottom end closures. Braun U.S. Pat. Nos. 3,912,576 and Re. 29,568 disclose a contoured end face of an ultrasonic vibrating tool providing a sealing pattern which accommodates changes in the number of layers of paperboard at different areas of bottom end closure of a tubular container mounted on a flat-faced mandrel.

SUMMARY OF THE INVENTION

A general object of the invention is to provide a thermoplastic-coated paperboard container with an improved bottom end closure which will sit flat and stand erect after being filled.

Another object of the invention is to provide an indexable rotor having mandrels on which tubular container blanks are mounted, wherein each mandrel has an improved end cap defining a configuration which, in conjunction with a cooperating improved pressure pad, produces four flat corner portions on the container bottom end closure confined between the pressure pad and each end cap.

A further object of the invention is to provide an indexable rotor having mandrels with end caps mounted thereon wherein the end face of each end cap is formed to include four flat corner extensions, with lower level depressions between each pair of extensions, and wherein the recessed portion between the pairs of extensions and depressions is formed to coincide with varying numbers of layers involved in the overlapping folded end panels of a containers, and a pressure pad formed complementary to the thus formed face of the end cap, the combination adapted to compress the multi-layered end closure therebetween to seal same.

These and other objects and advantages will become more apparent when reference is made to the following drawings and the accompanying description.

BEST MODE OF CARRYING OUT THE INVENTION

Figure 1:
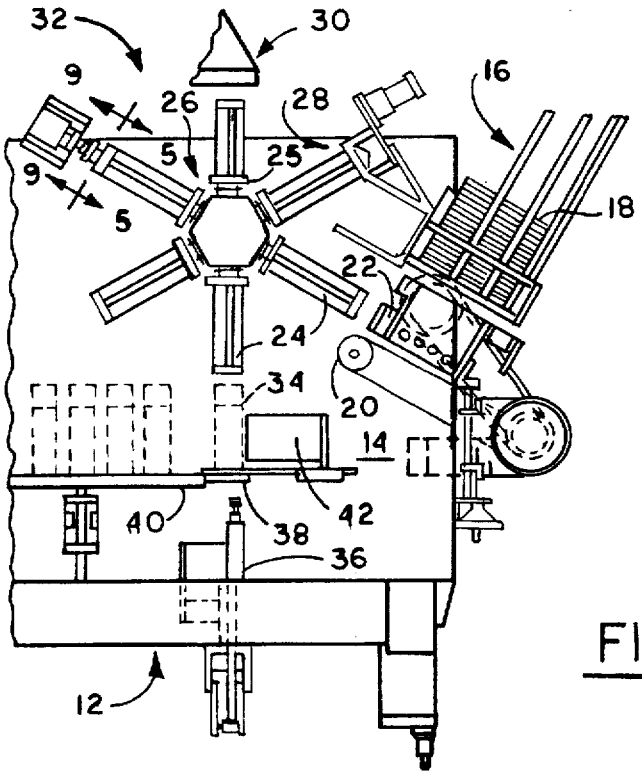
FIG. 1 is a fragmentary side elevational view of a forming, filling and sealing machine including a rotor with mandrels and their end caps, and a pressure pad embodying the inventive mechanism for forming container bottom closures which will sit flat and stand erect after the container is filled with a liquid.

Referring now to the drawings in greater detail, FIG. 1 illustrates a forming, filling and sealing machine 10 of the liquid packaging type, including a base frame 12 and a vertical support keel 14. A magazine 16 holding a plurality of folded-over, side-seam-sealed container blanks 18 is mounted on one end of the keel 14. A loading mechanism 20 is mounted on the keel just below the magazine 16 and adapted to withdraw one blank 18 at a time from the magazine while opening same into a four-sided tubular container blank 22 and then to load the individual tubular blank onto one of six mandrels 24 of an indexable turret mechanism 26 in approximately the 4:00 o'clock position. An adjustable stop member 25 may be operatively connected to each mandrel 24 to accommodate the forming of end closures of containers having the same cross-section but different heights.

As the mandrels index counterclockwise, each tubular blank 22 passes by a prebreaker unit 28, a heater 30, and a closing and sealing unit 32, to an unloading 6:00 o'clock position, having formed a bottom sealed but open-topped container, represented at 34. At the 6:00 o'clock position, each bottom-sealed container 34 is stripped from the mandrel 24 by a stripping unit 36, and placed on a stationary rail 38 adjacent a pair of parallel endless conveyors 40 whose indexing sequence is coordinated with that of the turret mechanism 26 through suitable cam means (not shown).

A transfer pusher 42 moves each open-topped container 34 from the rail 38 into suitable pockets (not shown) on the conveyor 40.

Each container 34 is progressively indexed at a constant indexing speed into positions beneath respective pre-breaker unit, filling unit, and closing and sealing unit (not shown) for the usual filling, closing and sealing process steps.

Figure 2:
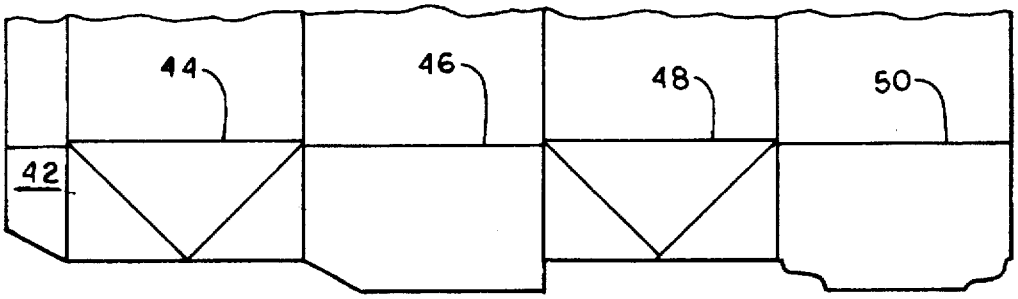
FIG. 2 is an enlarged fragmentary plan view of a container blank.

FIG. 2 illustrates a typical bottom end closure 41 of a container blank, including a side seam panel 42, and four end panels 44, 46, 48 and 50.

After the side seam panel 42 is sealed to the inner surface of the end panel 50, the resultant folded-over blank 18 is opened into the four-sided tube 22, as described above, and loaded onto a mandrel 24.

Figure 7:
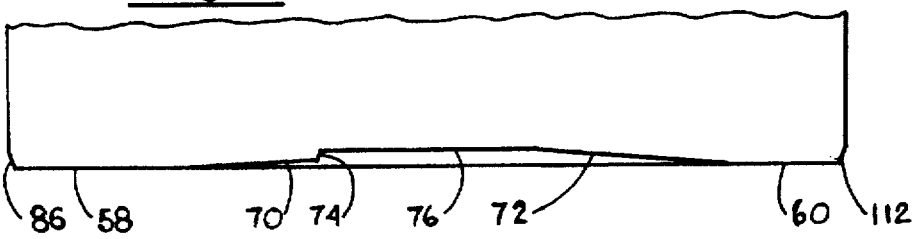
FIGS. 6 and 7 are end views taken along the respective planes of the lines 6—6 and 7—7 of FIG. 5, and looking in the directions of the arrows.
Figure 5:
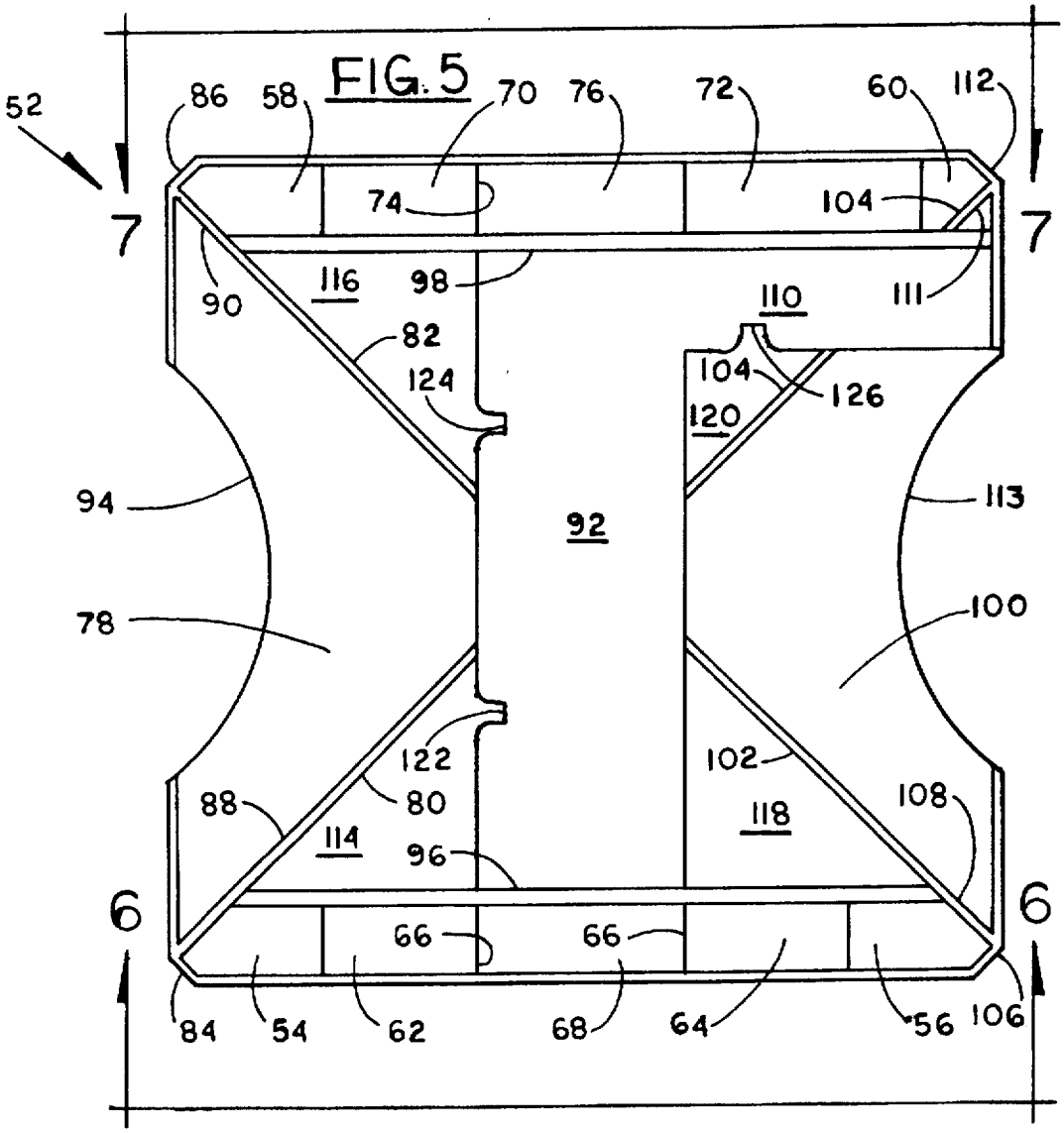
FIG. 5 is an enlarged view taken along the plane of the line 5—5 of FIG. 1, and looking in the direction of the arrows.
Figure 6:
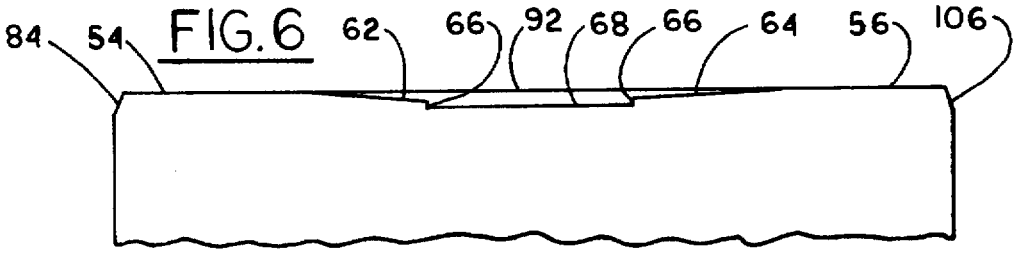

Referring now to FIGS. 5–7, the front face of an end cap 52 secured on the end of each mandrel 24 is seen to include protruding oppositely disposed, flat corner portions 54, 56, 58 and 60, each of a predetermined length and width. Converging, shallow tapered surfaces 62 and 64 extend downwardly from the flat corner portions 54 and 56, respectively, to steps 66 (FIG. 6) leading down to a horizontal surface 68. Converging, shallow tapered surfaces 70 and 72 extend downwardly from the flat corner portions 58 and 60, respectively. The surface 70 connects with a step 74 (FIG. 7) to a horizontal surface 76, while the surface 72 extends directly to the horizontal surface 76. The elements 54–76 remain constant for all container bottom end closure configurations.

Figure 3:
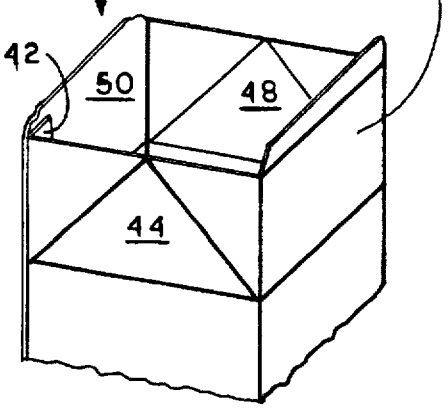
FIG. 3 is an enlarged fragmentary view of a four-sided tubular container blank formed and side-seam-sealed from the FIG. 2 blank, and mounted on the mandrel and end cap of the FIG. 1 structure.
Figure 4:
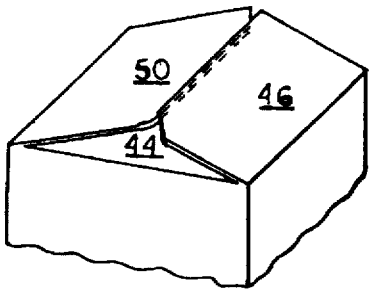
FIG. 4 is a fragmentary perspective view of the FIG. 3 tubular container blank in a partially closed condition.

Now, as an example, suitable for accommodating the end closure design of FIGS. 3 and 4, a first flat recessed portion 78 is formed by diagonal edges 80 and 82 converging from corners 84 and 86, past respective chamfered ends 88 and 90 of the flat corner portions 54 and 58. The edges 80 and 82 terminate at a lateral recessed portion 92. A first arcuate cut-out 94 is formed along the side of the end cap 52, at the center of the diagonal edges 80 and 82.

The recessed portion 92 extends to opposite tapered steps 96 and 98 (FIG. 5). The step 96 connects with the respective edge portions 68, 62, 64, 54 and 56 on one side. The step 98 connects with the respective edge portions 76, 70, 72, 58 and 60 on the other side.

A second flat recessed portion 100 is formed by further converging diagonal edges 102 and 104. The edge 102 extends from a corner 106 of the end cap 52, past a chamfered end 100 of the flat corner portion 56, to the lateral recessed portion 92. The diagonal edge 104 extends from the lateral recessed portion 92 to a segment 110 on the plane of the lateral recessed portion, and beyond the segment 110 past a chamfered edge 111 on the flat corner portion 60 to a corner 112. The segment 110 extends from the recessed portion 92 to the side edge of the end cap 52, parallel to the flat corner portion 60 and the tapered surface 72, separated therefrom by the adjacent tapered step 98. A second arcuate cut-out 113 is formed along the side of the end cap 52, directly opposite the first arcuate cut-out 94. The two cut-outs 94 and 113 provide for easy loading and unloading of the four-sided tubes 22 on and off the mandrels 24 by eliminating a possible vacuum retention therebetween.

Three similar triangular segments 114, 116 and 118 are respectively defined by the diagonal edges 80, 82, and 102, the lateral recessed portion 92, and the tapered steps 96 and 98. A smaller fourth triangular segment 120 is defined by a continuation of the diagonal edge 104, the tapered step 98, and the segment 110. The complete diagonal edge 104 is broken by the tapered step 98 and the segment 110.

The relative heights in descending order are (1) the flat corner portions 54, 56, 58 and 50; (2) the converging tapered surfaces 62, 64, 70 and 72; (3) the horizontal surfaces 68 and 76; (4) the flat recessed portions 78 and 100; (5) the recessed portion 92 and the segment 110; and (6) the triangular segments 114, 116, 118 and 120.

Three notches 122, 124 and 126 on the edges of the recessed portion 92 and the segment 110, serve to form indentations or, so-called, stake points, on the sealed bottom closure, serving to block off possible leak channels. The segment 110 cooperates with the side seam panel 42 of the folded bottom closure.

Figure 9:
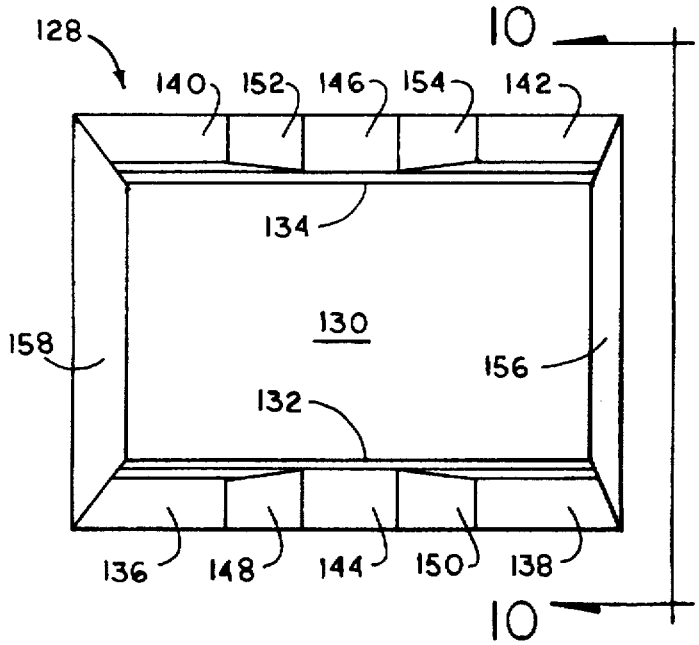
FIG. 9 is an enlarged view taken along the plane of the line 9—9 of FIG. 1, and looking in the direction of the arrows.
Figure 10:
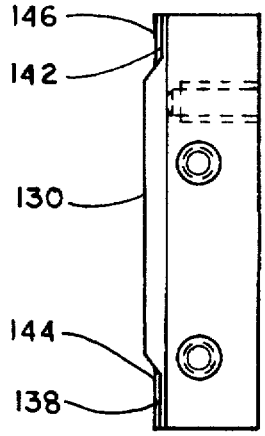
FIG. 10 is an end view taken along the plane of the line 10—10 of FIG. 9, and looking in the direction of the arrows.

Referring now to FIGS. 9 and 10, a pressure pad 128 is seen to be rectangular in shape, with an end face having a flat central portion 130 with short tapered edges 132 and 134 extending downwardly from the opposite longer sides thereof to four flat corner portions 136, 138, 140 and 142. The tapered edges 132 and 134 also communicate with central higher level horizontal surfaces 144 and 146. A longitudinally sloped surface 148 connects between the corner portion 136 and the horizontal surface 144. A longitudinally sloped surface 150 connects between the corner portion 138 and the horizontal surface 144. A longitudinally sloped surface 152 connects between the corner edge portion 140 and the horizontal surface 146. A longitudinally sloped surface 154 connects between the corner portion 142 and the horizontal surface 146. As such, the longitudinal edge portions of the pressure pad 128 are complementary to the adjacent longitudinal edge portions of the end cap 52, whereas the flat central portion 130 backs up the contoured intermediate portion of the end cap which cooperates with the various layers of the central portion of the carton bottom end closure.

A first chamfer 156 is formed at one of the shorter sides of the central portion 130, forming a 45° connection with opposite ends of the flat corner portions 138 and 142. A second larger chamfer 158 is formed at the other shorter side of the central portion 130, forming a further 45° connection with the other opposite ends of the flat corner portions 136 and 140. Suitable fastener means, represented at 159, serve to connect the pressure pad 128 to conventional reciprocal actuating means.

Figure 8:
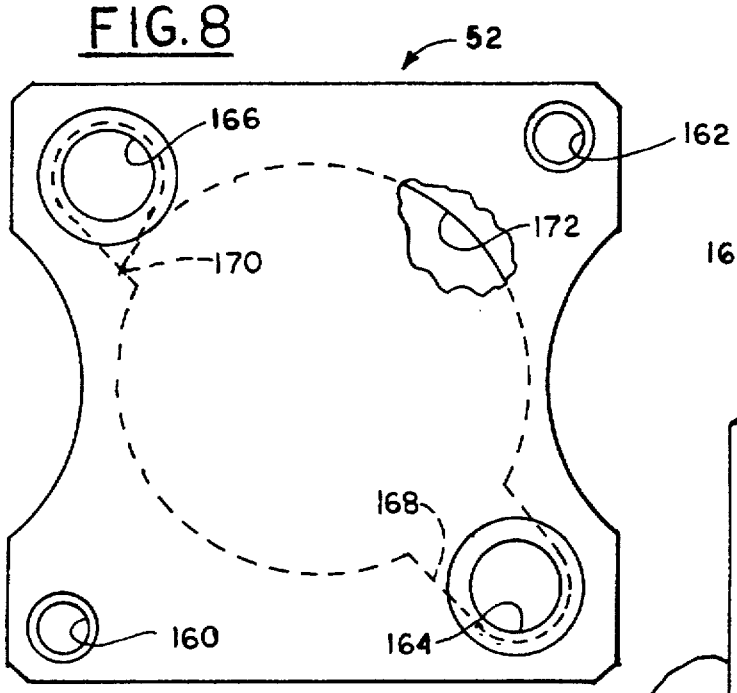
FIG. 8 is a plan view showing the opposite face of the FIG. 5 structure for abutting against the distal end of a mandrel.
Figure 11:
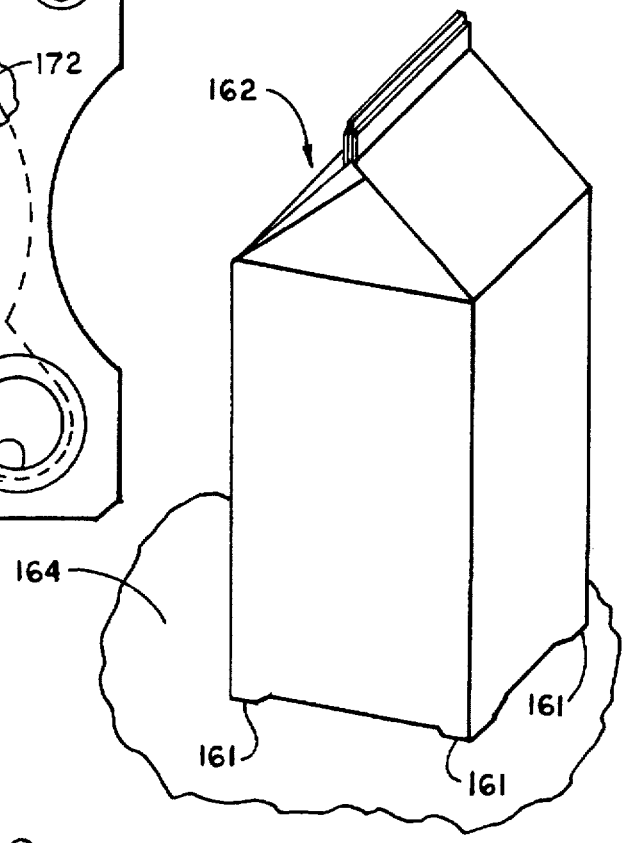
FIG. 11 is a perspective view of the finished filled container standing erect and sitting flat on a flat surface.

By referring now to FIG. 8, it is noted that there are two small diameter threaded openings 160 and 162 formed in opposite corner portions of the mandrel end cap 52 on the back face thereof. Two larger diameter threaded openings 164 and 166 are formed in the other two corner portions. The openings 164 and 166 communicate via respective outlets 168 and 170 with a central substantially circular hollow portion 172.

This arrangement of the back face of the end cap 52 is adaptable to fit threadedly on a four corner posts-type mandrel 24. The two posts which fit threadedly into the threaded openings 164 and 166 are hollow so as to permit water to flow therethrough and into the central hollow portion 172 to continually cool the end cap 52. On some turret applications, the mandrels 24 are hollow, water filled blocks, rectangular in cross-section, with oppositely disposed, longitudinally extending arcuate cut-outs (FIG. 1) aligned with the cuts 94 and 113 on the mandrel end cap 52.

In operation, the folded and overlapped end panels 44, 46, 48 and 50 are confined under a substantially constant pressure between the faces of the mandrel end cap 52 and the pressure pad 128, since the varying numbers of layers involved in the bottom closure have been considered, as described above, in the formation of the surface shape of the mandrel end caps 52 between the four flat corner portions 54, 56, 58 and 60, and their respective matching corner portions 138, 136, 142 and 140.

The resultant bottom end closure includes extended oppositely disposed side edge portions, with intermediate overlapped and sealed triangular and substantially rectangular end panels with a substantially flat outer side recessed below the extended side edge portions. Each extended side edge portions includes a pair of flat co-planar corner extensions or pedestals, a depressed horizontal surface at a mid-location therebetween, and a pair of tapered surfaces formed between the opposite ends of the horizontal surface and each of the pair of corner pedestals.

For other bottom end closure configurations, the surface shapes of the end caps 52 particularly, and possibly the pressure pad 128 between the respective oppositely disposed side edge portions would vary to suit the particular end closure involved, while the inventive four corner portions would be retained to form raised co-planar segments or corner pedestals 161 on the finished container 162, to assure that it will sit flat and stand erect on a flat surface 164, after the container is filled with a liquid, despite any bulging which might occur in the center portion of the container bottom.

INDUSTRIAL APPLICABILITY

It should be apparent that the invention provides a novel and efficient mandrel end cap and complementary pressure pad mechanism, for use in conjunction with a conventional forming, filling and sealing machine rotor, for forming a stable, flat-sitting bottom closure on a paperboard container, as well as providing the resultant novel stable container bottom closure.

It should be further apparent that the end cap may be fitted to the end of any mandrel design.

While but one embodiment of the invention has been shown and described, other modifications thereof are possible within the scope of the following drawings.

What is claimed is:

1. For use with a forming, filling and sealing machine indexing rotor having a plurality of mandrels for receiving tubular paperboard blanks, and external pre-breaking, heating and folding and sealing units for closing and sealing the bottom end closures of the tubular blanks, a mechanism comprising:

an end cap mounted on a mandrel, said end cap having first and second opposing end cap sides, and a pressure pad mounted on the folding and sealing unit, said pressure pad having first and second pressure pad sides corresponding to the first and second end cap sides;

wherein each end cap and associated pressure pad have complementary oppositely disposed side edge portions formed on respective faces of each of the associated first and second end cap sides and corresponding first and second pressure pad sides thereof so as to confine the bottom end closure therebetween to thereby form two pairs of corner pedestals on opposite sides of the bottom end closure;

wherein said complementary side edge portions on each said end cap face include two pairs of raised corner segments corresponding to said two pairs of corner pedestals, a depressed flat edge segment midway between two corner segments on each of the first and second opposing sides of said end cap face, and a tapered segment between each depressed flat edge segment and a raised corner segment on each of the first and second opposing sides of said end cap face; and wherein said complementary edge portions on said pressure pad includes two pairs of depressed corner segments corresponding to said two pairs of corner pedestals, a raised flat edge segment midway between two corner segments on each of the first and second opposing sides of said pressure pad, and a tapered segment between each raised flat edge segment and a depressed corner segment on each of the first and second opposing sides of said pressure pad.

2. The mechanism described in claim 1, and variously contoured segments formed on each said end cap for cooperation with various numbers of overlapping panel segments of the bottom end closure intermediate said oppositely disposed side edge portions of said end cap.

3. The mechanism described in claim 2, wherein said variously contoured segments are adapted to accommodate single, double, triple, and quadruple layers of panel segments during the sealing together thereof.

4. The mechanism described in claim 1, a flat center segment formed on said pressure pad intermediate said oppositely disposed side edge portions of said pressure pad.

5. The mechanism described in claim 1, wherein the mounting side of said end cap is adapted to fit on any mandrel design and to include provision for receiving water from a water source through said mandrel to maintain the faces of the end caps in a cooled condition.

* * * * *